US005249976A

United States Patent [19]

Brock

[11] Patent Number: 5,249,976

[45] Date of Patent: Oct. 5, 1993

[54] ELECTRICAL PLUG HAVING LOCKING MEANS

[76] Inventor: Roger D. Brock, 30800 Driftwood La., Spanish Fort, Ala. 36527

[21] Appl. No.: 969,378

[22] Filed: Nov. 2, 1992

[51] Int. Cl.[5] ..... H01R 13/20

[52] U.S. Cl. ..... 439/102; 439/270

[58] Field of Search ..... 439/102, 265, 270

[56] References Cited

U.S. PATENT DOCUMENTS 2,047,623 7/1936 Felts ..... 439/270

4,544,216 10/1985 Imhoff ..... 439/270 X

FOREIGN PATENT DOCUMENTS 1571883 7/1980 United Kingdom ..... 439/102

*Primary Examiner*—Eugene F. Desmond

*Attorney, Agent, or Firm*—Macdonald J. Wiggins

[57] ABSTRACT

An electrical plug for 3-wire line cords includes a plug body having a U-shaped grounding pin. A rise pin is disposed between opposing walls of the U-shaped grounding pin. A locking element extending through the plug body includes a threaded proximal portion and a flat distal portion, the distal portion having a ramp disposed over the rise pin and a serrate edge opposite the ramp with the distal portion disposed within the grounding pin opposing walls. A locking knob is threaded onto the proximal portion. With the plug in an outlet, the knob is rotated clockwise to draw the flat distal portion rearward causing the ramp to ride up the rise pin and to cause the serrate edge to grip the inner surfaces of the grounding socket. Rotating the knob counterclockwise releases the serrate edge to permit withdrawal of the plug from the outlet.

7 Claims, 1 Drawing Sheet

FIG. 1
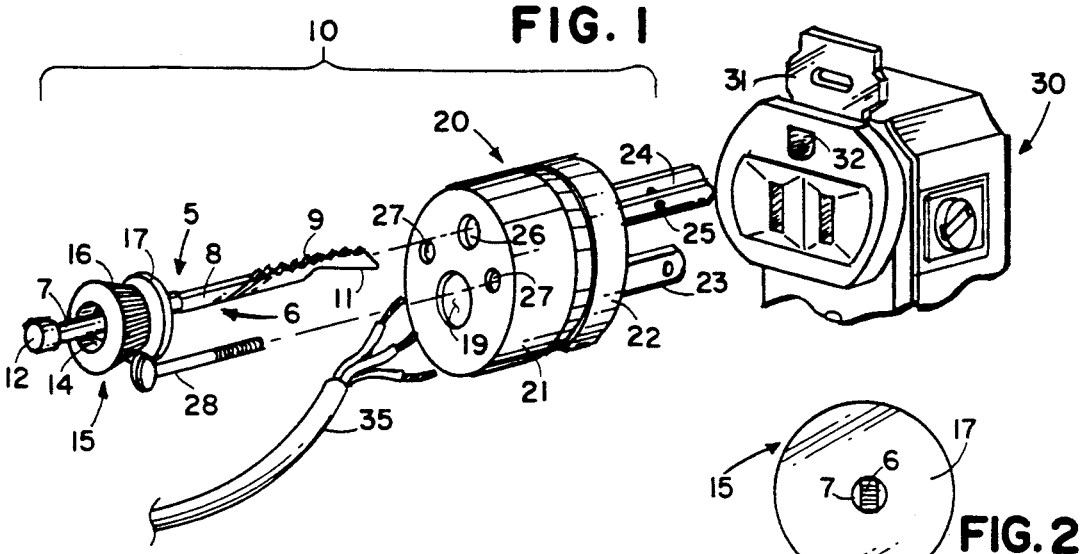
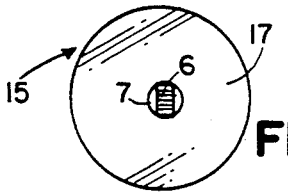
FIG. 2
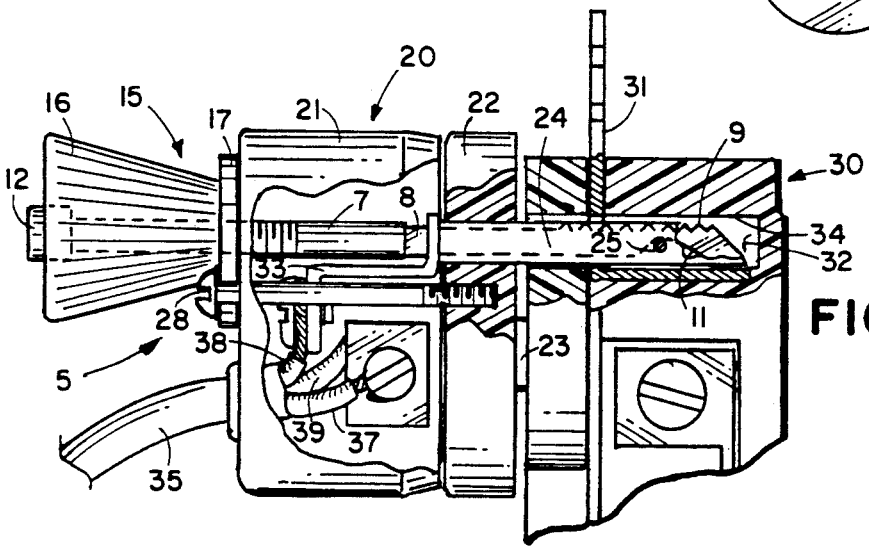
FIG. 3
FIG. 4A
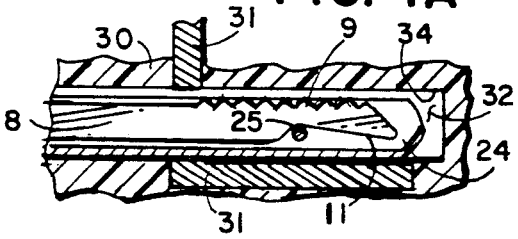
FIG. 4B
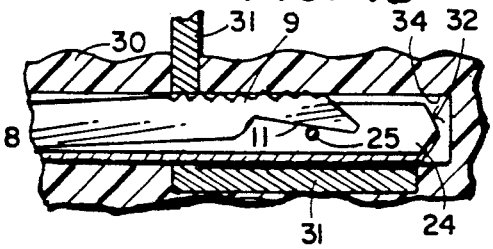

ELECTRICAL PLUG HAVING LOCKING MEANS

BACKGROUND OF THE INVENTION

1. Field of the Invention

The invention relates to plugs for 115 volt and 230 volt electrical line plugs, and more particularly to an electrical plug having means for temporarily manually locking the plug when plugged into an electrical outlet to prevent accidental disengagement of the plug from the outlet.

2. Description of the Prior Art

Current portable electrical devices in the United States utilize line cords having a plug for attachment to 115 volt and 230 volt outlets. The electrical codes require one wire of the supply lines to an outlet to be grounded at the distribution panel, and a separate grounding lead to be run from the panel to each outlet. To minimize possibilities of electrical shock, current electrical appliances, tools and the like having metal cases, frames, etc. are required to have three-wire cords in which a grounding wire is connected to such metal parts, and a pair of feed wires connected to the electrical device. The pair generally includes a pair of feed wires having a "hot" wire, and a neutral wire which is independent of the grounding wire connected to the metal parts.

The plug that connects to an outlet includes a pair of flat pins connected to the pair of feed wires, and a third, essentially U-shaped, grounding pin connected to the grounding wire. The outlet includes a matching socket for receiving the flat pins and the grounding pin. The grounding socket has an electrical connection to the grounding wire lead from the distribution panel.

Common line cord plugs in present use, when plugged into an outlet, are easily dislodged from the outlet. This problem is especially annoying when using tools and extension cords. A slight pull or strain on the line cord or the extension cord often disconnects the tool. Inconvenience and waste of time results. Thus, there is a need for a line cord plug that may be easily connected to an outlet and manually locked therein, and which can be quickly released when desired.

Prior art attempts at solving this problem include U.S. Pat. No. 4,111,509 to Novak which utilizes a split grounding pin that is expanded after insertion of the plug in an outlet. Hubbel et al., U.S. Pat. No. 2,683,864 teaches a grounding pin having a spring strip at its distal end, and a screw to push the strip against the outlet body. Other related references include U.S. Pat. Nos. 5,082,450; 3,890,025; 3,358,265; and 2,261,615.

SUMMARY OF THE INVENTION

The present invention is an electrical line cord plug having a pair of contact pins for insertion into an electrical outlet, with a separate U-shaped grounding pin for insertion into a grounding jack in the outlet. The pins project from a front surface of a flat base portion of the plug. A set of connection lugs is located on a back surface of the base. A removable cap element attaches to the back surface of the base and is provided with an opening to pass a three wire line cord.

For purposes of discussion, the invention will be explained with reference to a standard U.S. 115 volt circuit line cord plug. In such presently approved line cord plugs, the line connection pins are disposed in a parallel relationship, and the grounding pin is disposed spaced apart from the line connection pins. The U-shaped grounding pin of the invention is mounted to the base having an opening through the base aligned with the U-shaped pin. An outer face of the cap has an opening therethrough, aligned with the grounding pin opening. A rise pin is disposed through the opposing wall of the U-shaped grounding pin a short distance from the distal end of that pin.

A locking device is provided having a threaded cylindrical proximal end and a flat distal end. The distal end is formed to provide a short ramp portion from the tip rearward a short distance from the tip. The flat end has the edge opposite the ramp serrate to provide a gripping surface. The distal end of the device is inserted through the cap grounding pin opening into the U-shaped pin such that the ramp extends beyond the rise pin. In its normal position, the ramp is seated in the U-shaped pin over the rise pin with the serrate edge contained within the pin.

A knurled knob is threaded onto the proximal end of the locking device. The knob includes a circular skirt captivated against the back surface of the cap by a pair of screw heads. The screws also serve to attach the cap to the plug base. Rotating the knob counter-clockwise on the threaded portion of the locking device extends the flat distal end to the end of the grounding pin. The plug can then be inserted and removed from an outlet. After inserting the plug into an outlet, the knob is turned clockwise, causing the threaded portion of the proximal end to move rearwardly from the cap. This action causes the ramp at the distal end to ride up on the rise pin, forcing the serrate edge against interior surfaces of the grounding jack such that the serrate portion is contained within the U-shaped pin. The friction between the edge and the jack locks the plug in the outlet such that pulling on the line cord does not dislodge the plug. When it is desired to disconnect the plug from the outlet, the knob is backed off, and the locking device extends forward. As the ramp moves forward, the serrate edge of the device retracts into the U-shaped channel of the pin due to the elasticity of the flat portion thereof, permitting normal removal of the plug.

It is therefore a principal object of the invention to provide a line cord plug having means to temporarily lock the plug in an outlet to prevent inadvertent dislodging of the plug.

It is another object of the invention to provide a line cord plug having a locking device operated by turning a knob to lock the grounding pin in the grounding socket of the outlet.

It is still another object of the invention to provide a lockable line cord plug having a locking device with a serrate edge at a distal end thereof for creating a friction lock within the outlet grounding socket.

It is yet another object of the invention to provide a locking line cord plug that can be quickly and easily installed and removed from an outlet.

These and other objects and advantages o the invention will become apparent from the following detailed description when read in conjunction with the drawings.

BRIEF DESCRIPTION OF THE DRAWINGS

FIG. 1 perspective exploded view of the line cord plug of the invention shown with a partial view of a typical outlet;

FIG. 2 is a distal end view of the locking device element of the plug of FIG. 1;

FIG. 3 cutaway view of the plug of FIG. 1 inserted into an outlet prior to locking therein;

FIG. 4A is a cross sectional view of the grounding pin of the plug of FIG. 1 inserted into the grounding socket of an outlet prior to locking therein; and FIG. 4B is the cross sectional view of FIG. 4A after locking the plug of FIG. 1 therein.

DETAILED DESCRIPTION OF THE PREFERRED EMBODIMENT

The present invention is applicable to any type of plug and socket having a grounding pin separate from line pins. For purposes of illustration only, the invention will be described with reference to a common 115 volt plug.

Referring to FIG. 1, a line cord plug 10 is shown in partially exploded view. A plug body 20 is shown having a plug base 22 supporting a pair of line pins 23 (only one pin is seen in the perspective view), and a grounding pin 24 formed from U-channel stock having a pair of opposing walls. Grounding pins of this type are common in the art. A rise pin 25 is inserted across the opposing walls of the U-channel stock a short distance from the distal end thereof. Plug 20 also includes a rear cap portion 21 with opening 19 for line cord 35, opening 26 for locking element 5, and two screws 28 for attachment to plug base 22 via holes 27, in accordance with the preferred embodiment. Only one screw 28 is seen in FIG. 1. It is to be understood that other types of plug bodies may also be used including molded plugs having the line cord permanently connected to the pins.

Locking element 5 comprises a locking bar 6 with a rear threaded portion 7 and a front flat section 8, as shown in FIGS. 1 and 2. Flat section 8 is formed from flexible metal. The distal end of flat section 8 includes an inverted ramp 11, and a serrate edge 9 opposite ramp 11. A knurled knob 15 having internal threads is threaded onto rear portion 7, and includes knob portion 16 and circular skirt 17. A recess 14 is provided in the rear face of knob 15 to accept stop knob 12 when knob 15 is fully retracted.

Prior to installation of rise pin 25 in grounding pin 24, knob 15 is fully retracted, plug cap portion 21 is separated from base 22, line cord 35 is passed through opening 19, and the proper wires connected to the plug pins as indicated in FIG. 3. The cap portion 21 is replaced on base 22, and the distal end of locking bar 6 is inserted through opening 26 placing flat section 8 in the U-channel grounding pin 24. Rise pin 25 is then inserted, captivating locking element 5 in plug 10, as seen in FIGS. 3 and 4A. At this point, flat section 8 is within the opposing walls of grounding pin 24. In the cutaway view of FIG. 3, the locking plug of the invention is shown plugged into outlet 30. Although a typical wall outlet 30 is shown, it is to be understood that the invention can be used with any 115 volt or 230 volt outlet having a grounding socket or jack. The grounding socket 32 of outlet 30 includes spring contacts connected to outlet bracket 31 which connects to a grounding wire from the distribution panel. Referring to FIG. 3, knob 15 includes circular skirt 17 which is captivated by the two screws 28, which may also be used to mount cap 21 to base 22. Alternately, screws 28 may attach only to cap portion 21 which is attached to plug base 22 by peripheral screws.

The line cord grounding lead 38 connects to the grounding pin 24 via connection 33. The respective line pair leads 37, 39 are fastened to the respective line connectors. As shown in FIG. 3, knob 15 is fully retracted in position for insertion in which serrate edge 9 is within the opposing walls of grounding pin 24. The plug 10 can be easily removed from outlet 30 since flat bar 8 is in the fully retracted position. As may be noted, U-channel pin 24 is fully inserted in grounding socket 32 a shown in FIG. 3 and FIG. 4A. To lock plug 10 in outlet 30 knob 15 is turned against the rear surface of cap portion 21, drawing flat bar 8 rearward as indicated by arrow B of FIG. 4B. This action forces ramp 11 to ride upward on rise pin 25, thereby forcing serrate edge 9 against an upper interior surface 34 of socket 32 and outlet bracket 31. The serrate edge 9 grips the surface 34 and outlet bracket 31, thereby preventing removal of plug 10 from outlet 30.

For removal of plug 10, knob 15 is rotated to its retracted position, permitting bar 8 to return to the position shown in FIG. 4A and releasing serration 9 from socket 32. Plug 10 is then easily removed from outlet 30.

Although a preferred design for the plug assembly of the invention is shown for exemplary purposes, other configurations and plug body designs may be used without departing from the spirit and scope of the invention.

I claim:

1. An electrical line cord plug having means for temporary locking of said plug in an electrical outlet, said outlet having a ground pin socket, comprising:

a) a plug body;

b) a U-shaped grounding pin extending from a front surface of said plug body, said grounding pin having opposing walls;

c) a rise pin disposed across said opposing walls;

d) a locking device including a locking bar having a distal end extending from a rear surface of and through said plug body, and within said opposing walls of said grounding pin;

e) said distal end of said locking device having a ramp portion positioned over said rise pin, wherein movement of said locking device rearwardly causes said ramp portion and said distal end to ride up said rise pin above said opposing walls of said U-shaped grounding pin to thereby produce locking contact with interior surfaces of said ground pin socket;

f) said distal end of said locking device is formed of flat, flexible material, and a proximal end thereof is a threaded rod; and g) a threaded know disposed on said threaded rod whereby rotating said know causes said locking device to move in a selected direction.

2. The line cord plug as defined in claim 1 in which said plug body includes:

a base portion supporting said grounding pin, a pair of line pins, and connectors for receiving a set of line cord wires; and a cap portion attached to said base portion including openings for a line cord, and for said locking device.

3. The line cord plug as defined in claim 1 in which said threaded knob includes means for captivating said knob against said cap portion.

4. The line cord plug as defined in claim 3 in which said captivating means is a circular skirt on said threaded knob, and means attached to said plug body for engaging said skirt whereby said knob and skirt may rotate in said engaging means.

5. An electrical plug for connecting to electrical outlets having a grounding socket, comprising:

a) a plug body having a U-shaped grounding pin, b) a locking element having a threaded proximal portion and a flat portion extending forwardly therefrom, said flat portion having a distal end, said distal end inserted through said plug body, into said U-shaped grounding pin to a distal end thereof;

c) said distal end of said flat portion of said locking element includes a ramp portion along one edge thereof, and an opposing serrate edge thereof;

d) a rise pin inserted transversely through said U-shaped grounding pin to engage said ramp wherein said ramp portion of said flat portion distal end is contained within said U-shaped grounding pin when said locking element is in a first forward position, and said ramp rides up said rise pin to cause said serrate edge of said flat portion distal end to extend from legs said U-shaped grounding pin when said locking element is in a second rearward position to thereby bear against the interior of a grounding socket; and e) a knob threadedly disposed on said proximal end of said locking element wherein rotating said knob against a rear portion of said plug body causes said locking element to move rearwardly, thereby moving said locking element from said first forward position to said second rearward position.

6. The electrical plug as defined in claim 5 in which said knob includes:

a circular skirt portion; and means for captivating said knob and skirt to said plug body so as to permit rotation of said knob.

7. The electrical plug as defined in claim 6 which further includes a stop knob disposed at the proximal end of said threaded rod.

* * * * *